United States Patent [19]

Lok

[11] Patent Number: 4,873,767

[45] Date of Patent: Oct. 17, 1989

[54] SAFETY LETTER OPENER

[76] Inventor: Hin C. Lok, 205 Spyglass La., Walnutnster, Calif. 91789-2041

[21] Appl. No.: 209,017

[22] Filed: Jun. 20, 1988

Related U.S. Application Data

[63] Continuation-in-part of Ser. No. 124,267, Nov. 23, 1987, Pat. No. 4,803,782.

[51] Int. Cl.[4] ..... B26B 3/00

[52] U.S. Cl. ..... 30/278; 30/289

[58] Field of Search ..... 30/278, 241, 289, 293, 30/115, 2, 1, DIG. 3

[56] References Cited

U.S. PATENT DOCUMENTS

| | | | |
|---|---|---|---|
| 2,247,840 | 7/1941 | Harrison | 30/294 |
| 2,266,863 | 12/1941 | Hatch . | |
| 2,282,062 | 5/1942 | Jewett | 30/294 |
| 2,411,927 | 12/1946 | Luke | 30/278 |
| 2,672,933 | 9/1954 | Bridy | 164/73 |
| 2,679,098 | 5/1954 | Deicken . | |
| 2,679,100 | 5/1954 | Ehler | 30/294 |
| 2,815,572 | 10/1957 | Deicken . | |
| 2,882,598 | 4/1959 | Fidelman . | |
| 2,978,808 | 4/1961 | Reed | 30/278 |
| 3,137,070 | 6/1964 | Geier et al. | 30/239 |
| 3,142,119 | 7/1964 | O'Brien | 30/278 |
| 3,619,902 | 11/1971 | Fleury | 30/294 |

FOREIGN PATENT DOCUMENTS 466975 2/1969 Switzerland .

*Primary Examiner*—Frank T. Yost
*Assistant Examiner*—Willmon Fridie, Jr.
*Attorney, Agent, or Firm*—Charles H. Thomas

[57] ABSTRACT

An implement is provided for opening envelopes in which a ram is reciprocally mounted within a hollow sleeve. A transverse envelope receiving crevice or slot is defined at one end of the sleeve and the ram carries a blade which has a cutting edge directed toward the envelope receiving slot. A spring acts between the sleeve and the ram to urge the cutting edge of the blade away from the transverse slot so that the blade is not exposed unless the spring bias is overcome.

16 Claims, 1 Drawing Sheet

SAFETY LETTER OPENER

BACKGROUND OF THE INVENTION

The present application is a continuation in part of U.S. application Ser. No. 124,267, filed on Nov. 3, 1987, now U.S. Pat. No. 4,803,782.

FIELD OF THE INVENTION

The present invention relates to an improved implement for opening letter envelopes.

DESCRIPTION OF THE PRIOR ART

Conventional letter openers or letter envelopes are elongated devices constructed with handles that terminate in narrow blades. To use a conventional letter opener, the tip of the blade is inserted into a small gap formed at an edge of the envelope where the envelope flap is folded over and sealed to the body of the envelope. The envelope is then held immobile and the blade is pulled along the length of the flap at the fold therein while tension is exerted between the fold of the flap and the body of the envelope.

Conventional envelope opening devices are inadequate for several reasons. Not infrequently the blade of a conventional letter opening device will engage not only the fold of the flap of the envelope, but also folded papers within the envelope. When this occurs the cutting action of the blade severs not only the envelope, but also papers within the envelope.

The process of opening an envelope with a conventional letter envelope opener is also relatively slow. The user must first locate an opening adjacent to a strip of adhesive on the envelope flap, insert the tip of the letter opener into that opening, and then run the letter opener along the length of the fold of the flap. In this process the time required to locate the opening and insert the tip of the letter opener into the opening constitutes a substantial portion of the total time required to open the envelope. While the total time required to open a single envelope is minimal, the labor cost in opening a multitude of envelopes in large mailrooms with conventional letter openers is very substantial. Furthermore, the time required for opening mail is further lengthened when the letter opener engages papers within the envelope, in the manner previously described, and also when the letter opener snags on a paper clip or staple within the envelope. The delay in disengaging the letter opener from a paper clip or staple is not insignificant when a large number of envelopes are to be opened, and such delays recur a number of times.

Further delays in opening mail are frequently encountered when the envelope construction is such that a gap at the fold of the flap cannot be located. Most envelopes are constructed in a manner such that the strips of moisture sensitive adhesive do not extend entirely to the area of the fold. However, this is not true of all envelopes. In some envelopes the adhesive strips do extend entirely along both edges of the envelope flap, so that a gap at the fold within which to insert the envelope opener does not exist. This difficulty is also encountered when the flaps of envelopes are sealed with tape. The only solution when such a difficulty arises is to manually tear the envelope so as to create an opening for insertion of the letter opener blade. The contents of the envelope may also be torn when this proves necessary, and in any event a delay is occasioned.

While various implements have been devised to attempt to overcome the difficulties of conventional letter envelope openers, most such devices have been overly complex and expensive or unsatisfactory in their operation. One letter opening device intended to overcome some of the shortcomings of prior letter envelope openers is described in U.S. Pat. No. 3,619,902. This device describes a hand held device in which a blade is movable in longitudinal reciprocation with the housing and is spring biased to extend across a transverse channel designed to receive the edge of a letter envelope. The bias of the spring is overcome to allow an envelope to be inserted into the transverse slot, and the blade is then released. However, several disadvantages exist in the operation of this device.

Because the force with which the blade bears against the envelope is controlled entirely by the spring, the blade will sometimes bear too heavily against the structure of the envelope, thus resulting in seizure and tearing of the envelope when the envelope is pulled lengthwise along the transverse slot. At other times the blade bears too lightly against the envelope, thus failing to open it when the envelope is pulled through the slot. Furthermore, since the blade is spring biased outwardly into the slot it is normally exposed. This can cause injury to the user's hand if the device is handled inattentively, and is very likely to cause damage to objects in the immediate vicinity. For example, when the device is carried in a purse or handbag the exposed cutting edge of the blade can slice the lining of the bag or cut other articles within the bag. Furthermore, the blade is very likely to become dull or broken, since coins, keys and other metal objects will frequently lodge in the slot and dull the cutting edge of the blade.

The letter opener of my prior U.S. patent application Ser. No. 124,267, filed on Nov. 23, 1987, does solve many of the deficiencies of conventional letter openers. However, my prior device does involve a number of separate, movable parts which must be fabricated and assembled together. The present invention provides an improved letter opener of considerably simplified instruction, as contrasted with my earlier device.

SUMMARY OF THE INVENTION

The present invention is directed to an improved envelope letter opening implement which may be used to open letter envelopes far more quickly than is possible with conventional envelope openers. Unlike many conventional envelope openers, the implement of the invention does not require the presence of an opening at which a tear is to be initiated. To the contrary, the envelope opening implement of the invention initiates a cut along one edge of the envelope by penetration from without, rather than by an initial insertion into an opening and tearing from within. Consequently, time is not lost in searching for an appropriate opening at the edge of the flap of the envelope so as to initiate a tearing action.

A further advantage of the invention is that the contents of an envelope cannot be damaged utilizing the envelope opening implement of the invention. It is not necessary to insert a blade deep into the interior of an envelope where it is likely to engage the contents of the envelope using the envelope opening implement of the invention. To the contrary, the blade of the implement of the invention is directed through the structure of the envelope only along a very narrow margin extremely close to an edge of the envelope.

The device of the invention employs a body having an envelope receiving slot, channel or crevice. Both the width and depth of the slot are quite small. Once the edge of the envelope is inserted into the slot, the blade of the envelope opening implement is directed laterally into the slot, but not entirely across the width of the slot. Consequently, once the envelope is pulled through the slot the blade slices through the structure of at least one side of the envelope, but without totally impaling and immobilizing the envelope within the slot.

A significant advantage of the letter opener of the present invention resides in the fact that it employs a spring biasing means which urges the blade away from the slot, so that the blade is only exposed during the act of slitting an envelope. The device of the invention employs a ram which is guided in longitudinal reciprocation within a cavity in a surrounding sleeve or slide. The sleeve is formed with a transverse channel of fixed, predetermined width at one end extremity thereon. The ram is disposed within the cavity in the hollow sleeve and carries a blade having a cutting edge directed towards the transverse channel. However, a spring acting between the ram and the sleeve urges these relatively movable elements in such a manner that the cutting edge of the blade is held retracted within the cavity of the sleeve unless manual force is exerted to overcome the bias of the spring.

As a result of this construction the blade of the letter opener of the present invention is totally enclosed when not in use. Since the device is normally carried in a pocket or handbag, together with a user's other personal belongings such as money, keys, nail clippers and the like, the retracted blade cannot slice the lining of a purse or cut the fabric of a pocket. Furthermore, even if keys or coins do lodge within the transverse channel or slot, the blade of the letter envelope will not be blunted by metal to metal contact, since the blade does not extend into the slot when not in use.

A further very significant advantage of the invention is that pressure with which the blade is pressed against an envelope when the device is utilized to open an envelope is entirely determined by the user. The user employs a manual force to move the sleeve and ram in longitudinal reciprocation relative to each other so that the cutting edge of the blade penetrates into the transverse channel once a letter to be opened has been inserted into the channel. However, unlike some prior devices, the force with which the blade bears against the envelope is entirely under the user's control.

A user can sense by the nature of the resistance of the passage of an envelope through the transverse slot if too much or too little force is being used to press the blade against the envelope. If the force is too great the envelope will tend to seize and tear. This effect is immediately detected by the tactile senses of the user. In such a circumstance considerable resistance will be felt both by the hand of the user pulling the envelope through the slot, and by the hand of the user which is exerting the force to overcome the spring bias. The corrective action of reducing the force on the blade is performed almost instinctively by the user. Similarly, the lack of any significant resistance in pulling the envelope through the slot will be immediately signaled by the tactile senses of the user. Again, the user will increase the force to cause the cutting edge of the blade to penetrate further into the transverse slot, almost instinctively.

In one broad aspect the present invention is a device for opening an envelope comprising a hollow sleeve defining an envelope receiving slot. A ram extends into the sleeve whereby the sleeve and the ram are movable relative to each other in longitudinally reciprocal fashion. A blade is mounted on a ram and has a cutting edge directed toward the slot. A means is provided for adjustably limiting the extent of relative longitudinal movement between the ram and the sleeve to prevent the cutting edge of the blade from extending across the entire width of the slot. A biasing means is disposed to urge the cutting edge of the blade away from the slot.

The width of the slot is preferably no greater than about 0.5 centimeters and the depth of the slot beneath the blade is preferably even less. The slot defined in the body is a crevice which is preferably o a U-shaped or channel-shaped configuration and the distance from the blade to the floor of the channel is preferably no greater than two millimeters.

To open an envelope the device of the invention is preferably held with the channel-shaped slot inverted over the tope edge of the envelope. This allows the contents of the envelope to drop toward the opposite, lower edge, and away from the upper edge. When the upper edge of the envelope is inserted into the slot, the user overcomes the bias of the spring to force the blade longitudinally into the transverse slot. The envelope is then drawn through the slot. The longitudinally projecting blade presses against the structure of the envelope a distance of only about two millimeters or less from the upper edge of the envelope. The chances of the contents of the envelope being damaged are thus extremely minimal.

The blade employed in the letter opening device of the invention is preferably a razor-type blade normally shaped in a parallelogram configuration with cutting edges on opposite ends. The cutting edges of the blade are inclined at an angle relative to the length of the blade and the blade is removably and reversibly mounted on a ram within the hollow sleeve.

Preferably, either one or the other of the ram and the surrounding sleeve is formed with a laterally projecting, depressible member. The other of the sleeve and the ram is formed with a longitudinally aligned track which is closed at both ends. The depressible member thereby extends into the track to releasably hold the sleeve on the ram. However, the depressible member can be depressed, thus allowing the ram and the sleeve to be separated from each other.

When the ram and sleeve are separated the blade is exposed so that the disposition of the blade can be reversed. Thus, a fresh cutting edge of a double edged blade may then be directed toward the transverse channel. The ram and the sleeve are then reengaged with each other so that the depressible member again rides in the track and holds the ram and sleeve together until purposeful separation is desired.

The blade can also be reversed in the disposition in which it is mounted upon the ram so that the cutting edge may alternatively be inclined toward either of the opposite ends of the transverse channel. Thus, the letter opening device of the invention can easily be converted for either right-handed or left-handed use. Also, when one cutting edge of the blade becomes dull, the blade is simply turned one hundred eighty degrees within the body of the implement, thereby orienting the opposite cutting edge in a position for use.

Only the very extreme tip of the razor blade extends into the channel approximately midway along the total depth of the channel. The channel is preferably no greater than 0.5 centimeters in width so that user cannot inadvertently insert a fingertip into the channel where it might be injured by the razor blade. Although the cutting edge is quite sharp, it is never exposed except during operation, unlike a conventional letter opener. Consequently, it is much safer to use and carry than a conventional opener.

The means for adjustably limiting the extent to which the cutting edge projects into the slot preferably may include a circular dial which is eccentrically mounted on a handle from which the ram projects. The dial is located in the path of movement relative to the slide or sleeve mechanism. Pressure is exerted by a finger of a user on the end of the slide or sleeve mechanism to urge it toward the ram. This relative longitudinal reciprocal movement between the slide and the ram causes the cutting edge of the blade to project into the slot. The dial forms an abutment which limits the longitudinal movement of the slide.

By selectively rotating the dial about its eccentric axis, the longitudinal limit of movement of the slide can be altered thereby altering the extent to which the tip of the cutting edge of the blade projects into the slot. The dial is configured so that even when the slide is permitted to move a maximum length along its path of travel, the tip of the cutting edge will not extend entirely across the width of the slot. In all embodiments of the invention the blade remains entirely withdrawn from the transverse slot or channel until the sleeve and ram are moved in relative longitudinal reciprocation by manual force exerted to overcome the spring bias.

The invention may be described with greater clarity and particularity by reference to the accompanying drawings.

Figure 2:
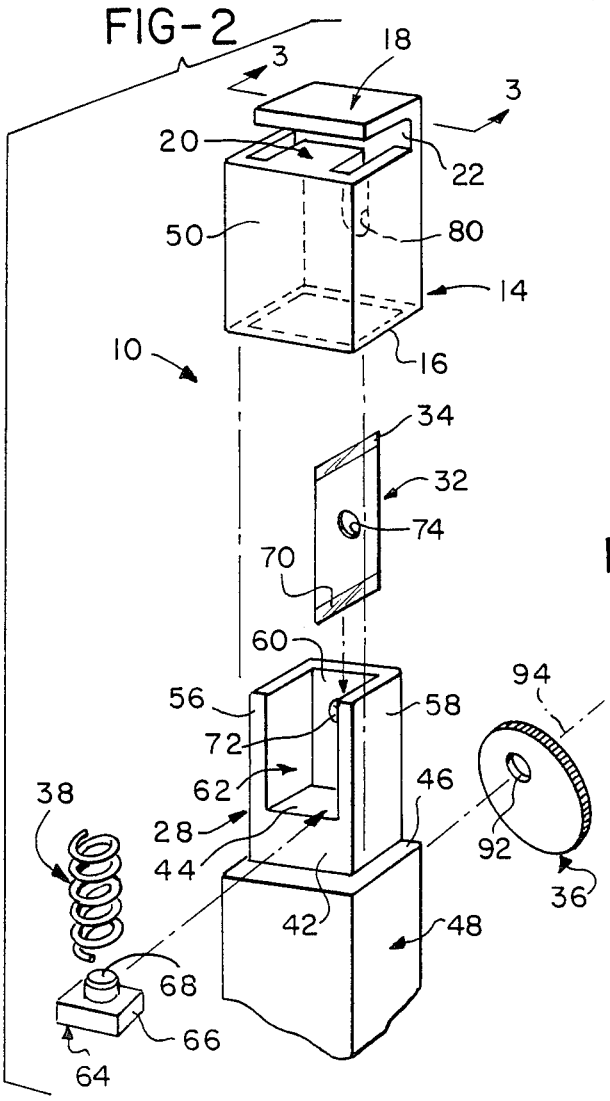
FIG. 2 is an exploded perspective view of the operating portion the envelope opening device of FIG. 1.

5 is a side sectional elevational view of the implement of FIG. 2 shown in its operating condition.

DESCRIPTION OF THE EMBODIMENT

Figure 1:
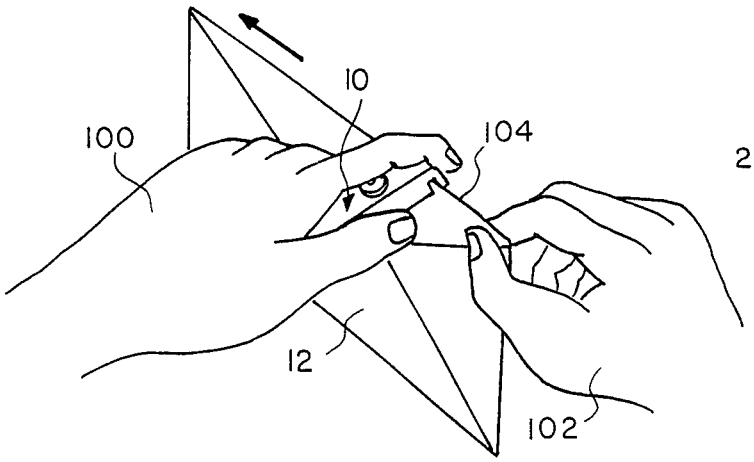
FIG. 1 is view illustrating the manner of use of a preferred embodiment of a safety envelope opening implement according to the invention.

FIG. 1 illustrates the manner of use of an implement 10 constructed in accordance with the invention. The implement 10 is used for opening envelopes such as the envelope 12. The implement 10 is comprised of a hollow sleeve 14, a ram 28, a blade 32, and a coil spring 38.

Figure 3:
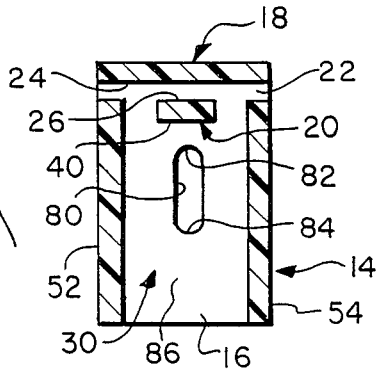
FIG. 3 is a front sectional elevational detail of the slide or sleevw of the implement of FIG. 2 taken along the lines 3—3 thereof.

The sleeve 14 is depicted in isolation in FIGS. 2 and 3, and is constructed generally in the form of a hollow, rectangular prism. The sleeve 14 is open at its lower end 16 and is closed at its opposite end by a transverse end wall 18 and by a transverse partition 20 which together define a transverse envelope receiving crevice, slot or channel 22. The channel 22 is of predetermined width as defined by the distance between the interiorly facing side 24 of the end partition 18 and the side 26 of the partition 20. The facing sides 24 and 26 of the partitions 18 and 20 respectively form the walls of the channel 22. The width of the channel 22 is preferably no greater than about 0.5 centimeters. The distance between the floor of the channel 22 and the facing surface of the blade 32 when the blade is extended into the channel 22 is likewise predetermined and preferably is no greater than about 2 millimeters. Interiorally of the partition 20 the sleeve 14 defines a cavity 30 of rectangular cross section.

The ram 28 is likewise shaped generally as a rectangular prism and is of a size which fits within the cavity 30 defined within the sleeve 14. The ram 28 is mounted for longitudinal reciprocation within the cavity 30 and extends into the open end 16 of the sleeve 14. A parallelogram shaped blade 32 is also disposed within the cavity 30 and has a cutting edge 34 directed at an inclination toward the envelope receiving crevice or channel 22. An adjustable blade movement control means is provided in the form of a disk 36 which is eccentrically mounted with respect to one or the other of the ram 28 and the slide or sleeve 14. The disk 36 is movable in longitudinal reciprocation into abutment with the other of the ram 28 and sleeve 14. The adjustable disk 36 limits the extent to which the cutting edge 34 of the blade 32 projects into the crevice or channel 32. This limit of projection is less than the width of the channel 22. The implement 10 is further comprised of a spring 38 which acts between the sleeve 14 and the ram 28 to urge the cutting edge 34 of the blade 32 away from the transverse crevice or channel 22 and into the cavity 30.

The cavity 30 is of uniform cross section throughout the longitudinal length of the sleeve 14 and is of a square or rectangular cross sectional configuration. The side 40 of the transverse partition 20 defines a transverse bearing wall against which the upper end of the spring 38 presses.

The ram 28 likewise has a uniform cross sectional configuration. This configuration corresponds to that of the cavity 30 which is bounded by the interior surfaces of the sleeve 14. As illustrated, the ram 28 is formed with a base 42, the upper surface 44 of which also defines a transverse bearing wall. The transverse bearing wall 44 of the ram 28 is longitudinally displaced from the opposing parallel transverse bearing wall 40 of the sleeve 14. A U-shaped abutment ledge 46 is defined at the transition between the ram 28 and a handle 48 and is dimensioned to correspond to the wall thickness of the front wall 50 and the side walls 52 and 54 of the slide 14.

The ram 28 is also formed with side walls 56 and 58 and a back wall 60 that rise upwardly from the base 42 in a U-shaped configuration, as best illustrated in FIG. 2. Together, the side walls 56 and 58 of the ram 28, the back wall 60 of the ram 28, the front wall 50 of the slide 14, and the opposite transverse bearing end walls 40 and 44 of the slide 14 and the ram 28, respectively, define a spring compartment 62. The enclosed spring compartment 62 defined by the ram 28 and the slide 14 is of oblong, rectangular configuration.

Figure 4:
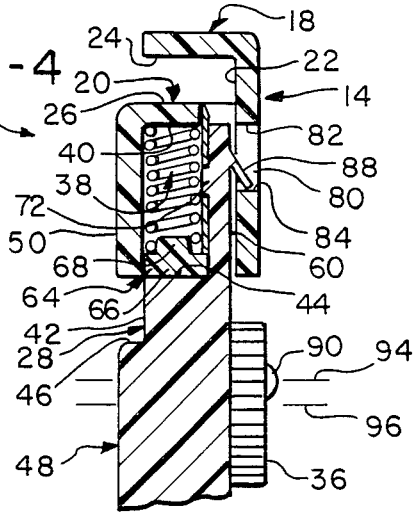
FIG. 4 is a side sectional elevational view of the implement of FIG. 2 shown in its normal condition prior to operation.
Figure 5:
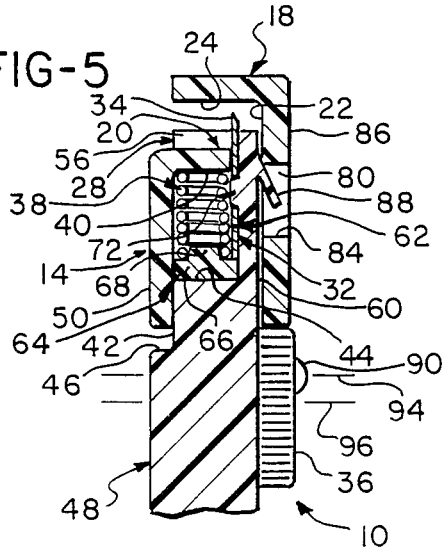

The spring compartment 62 accommodates the coil spring 38 which is compressed and disposed between the slide 14 and the ram 28 as best illustrated in FIGS. 4 and 5. The wall 40 is formed by the structure of the slide 14 and the wall 44 is formed by the structure of the ram 28. The compressed coil spring 38 is longitudinally aligned and oriented within the compartment 62 and is compressed between the opposite end walls 40 and 44.

A spring guide 64 is interposed between the spring 38 and the end wall 44 of the base 42 of the ram 28. The spring guide 64 has a base 66 formed in a rectangular configuration to fit into the spring compartment 62 against the bearing wall 44. A disk shaped center projection 68 extends upwardly from the base 66 and fits concentrically within the lowermost coils of the spring 38. The spring guide 64 thereby serves as a means for maintaining the coil spring 38 in longitudinal alignment between the transverse bearing walls 40 and 44. The spring guide 64 also aids in immobilizing the lower edge 70 of the blade 32 within the spring compartment 62.

As illustrated in FIGS. 2, 4 and 5, the back wall 60 of the ram 28 defines a laterally projecting stud 72 which extends a short distance outwardly into the spring compartment 62. The blade 32 is provided with a surface discontinuity in the form of a central, circular aperture 74 therethrough. The laterally projecting stud 72 on the back wall 60 of the ram 28 is located in longitudinal alignment with the aperture 74 of the blade 32 when the blade 32 is seated in the spring compartment 62. The stud 72 thereby fits into and extends through the aperture 74. The blade 32 is thereby immobilized relative to the ram 28 by engagement of the laterally projecting stud 72 in the aperture 74 of the blade 32. The stud 72 thereby keeps the lower blade edge 70 from contacting the bearing wall 44.

As previously noted, the spring guide 64 further aids in immobilizing the blade 32, since the lower edge 70 of the blade 32 is laterally entrapped between the base 66 of the spring guide 64 and the back wall 60 of the ram 28. The spring guide 64 aids in constraining the blade 32 against lateral movement within the spring compartment 62. While the aperture 74 extends completely through the blade 32, it is to be understood that the blade 32 could be formed with a notch or any other surface discontinuity in registration with the blade engaging stud 72.

As best illustrated in FIG. 3, the sleeve 14 is formed with a longitudinally oriented, elongated track 80 which is closed at both of its rounded ends 82 and 84. The track 80 is formed as a slot which extends entirely through the structure of the back wall 86 of the sleeve 14. As illustrated in FIGS. 4 and 5, a downwardly inclined depressible tang 88 is formed on the outwardly facing surface of the back wall 60 of the ram 28.

The tang 88 resides in registration with the track 80 and normally projects into the track 80 to hold the ram 28 and the sleeve 18 together in a releasable manner. That is, as is evident from FIG. 4, the sleeve 14 cannot be pulled upwardly and free of the ram 28 with the tang 88 projecting into the track 80, since the tang 88 will lodge in abutment against the end 84 of the track 80, thereby preventing the ram 28 and the sleeve 14 from separating. However, when it is desired to change the blade 32 or reverse the orientation of the blade 32 within the spring compartment 62, a user merely inserts a small implement, such as a pen or pencil, into the track 80 to depress the tang 88 inwardly toward the back wall 60 of the ram 28 a sufficient distance so that the tang 88 no longer projects into the track 80. The sleeve 14 can thereupon be releasably withdrawn from the ram 28.

Once the blade 32 has been reoriented or replaced, the sleeve 14 is merely moved into longitudinal alignment with the ram 28 and the ram 28 is inserted into the open end 16 of the sleeve 14. As the ram 28 and the sleeve 14 are moved together the depressible nature of the tang 88 will allow the back wall 86 of the sleeve 14 to force the tang 88 inwardly toward the back wall 60 of the ram 28 to allow the back wall 86 of the sleeve 14 to clear the tang 88. Once the sleeve 14 and the ram 28 have been pushed together sufficiently the tang 88 will arrive in registration with the track 80. Thereupon it will spring outwardly to again releasably engage and hold the sleeve 14 and the ram 28 together.

In the embodiment of the implement 10 depicted and described, the disk 36 is mounted for rotation relative to the ram 28 by means of a fastener 90 which has a shank that extends through the opening 92 in the disk 36 and into the structure of the handle 48. The disk 36 is thereby eccentrically mounted about an axis 94 that is perpendicular to the plane of the disk 36.

The disk 36 is mounted for adjustable rotation about an eccentric axis 94 oriented perpendicular to the direction of longitudinal reciprocation of the sleeve 14. The disk 36 may be rotated between a position in which the widest portion of its structure faces the sleeve 14 and a position in which the narrowest portion of its structure faces the sleeve 14, as depicted in FIG. 5. When rotated to the disposition of FIG. 5 the reciprocal range of the sleeve 14 is at a maximum, since the structure of the disk 36 limits the forward advance of the sleeve 14. The eccentrically mounted disk 36 is located in the path of longitudinal movement of the sleeve 14. Conversely, when the disk 36 is rotated about the axis of the shank of the fastener 90 to bring the widest portion of the structure of the disk 36 into abutment facing the external sleeve 14, the range of longitudinal reciprocation of the sleeve 14 relative to the ram 28 is minimized.

As illustrated in FIGS. 4 and 5, the disk 36 has been rotated relative to the handle 48 so that the eccentric axis of rotation 94 resides between the sleeve 14 and the geometric axis 96 and in linear alignment therewith. This allows the sleeve 14 and the ram 28 to be moved together to the maximum extent possible, as illustrated in FIG. 5. However, even in this position the cutting edge 34 of the blade 32 projects into the channel 22 less than the predetermined width thereof. Rotation of the disk 36 in any direction about the eccentric axis 94 will only result in a reduction of the extent to which the blade 32 protrudes into the channel 22.

The eccentrically mounted disk 36 is designed to halt relative movement between the sleeve 14 and the ram 28 within a variable distance selected within a predetermined range. By rotating the disk 36 the advanced position of the blade 32 can be closely adjusted to fine tune the precision cutting clearance between the cutting edge 34 of the blade 32 and the facing surface 24 of the end partition 18 to compensate for tolerances, blade wear and resiliency of the structural components of the device.

In the operation of the implement 10, the user grips the envelope opening device 10 in one hand 100 and at the same time grips an envelope 12 to be opened in the other hand 102. The top edge 104 of the envelope 12 is then inserted into the slot or channel 22 near the fingers of the user's hand 102. The user then uses the forefinger of the hand 100 to squeeze on the sleeve 14 to press the sleeve 14 and the ram 28 together to thus bring the cutting edge 34 of the blade 32 out of the cavity 30 within the sleeve 14 to a position such as that depicted in FIG. 5. In so doing, the user overcomes the bias of the compressed coil spring 38 which urges the ram 28 away from the end of the sleeve 14 at which the transverse partition 18 is located. The corresponding cross sectional configurations of the longitudinally extending walls 56, 58 and 60 of the ram 28 and that of the walls 50, 52, 54 and 86 of the sleeve 14 serve as a guide to ensure that only relative longitudinal reciprocal movement occurs between the sleeve 14 and the guide 28.

With the end partition 18 pressed inwardly toward the ram 28, as depicted in FIG. 5, the user in a quick movement runs the letter opening device 10 along the upper edge 104 of the envelope 12 away from the hand 102. The envelope edge 104 is pinched between the cutting edge 34 of the blade 32 and the interiorly facing surface 24 of the end partition 18. As the envelope 12 is pulled through the transverse slot 22, either one or both sides of the paper of the envelope 12 will be neatly sliced, thus allowing the contents of the envelope 12 to be readily withdrawn. The forwardly projecting cutting edge 34 of the blade 32 will slice an opening in at least the side of the envelope 12 facing the blade 32 along the entire top edge 104. When the user releases the forefinger from the transverse end partition 18 of the sleeve 14, the coil spring 38 will push the sleeve assembly 14 away from the ram 28, thereby withdrawing the cutting edge 32 back into the cavity 30 of the sleeve 14.

Undoubtedly, numerous variations and modifications of the invention will become readily apparent to those familiar with letter opening devices. For example, the track 80 could be formed on the ram 28 while the tang 88 could be formed on the sleeve 14. Accordingly, the scope of the invention should not be construed as limited to the specific embodiment of the invention depicted and described herein, but rather is defined in the claims appended hereto.

I claim:

1. A device for opening an envelope comprising a hollow sleeve formed by longitudinal surrounding walls extending parallel to a linear longitudinal direction of movement and which define a cavity therewith having an open end and at its opposite end a solid end wall extending perpendicular to said longitudinal direction of movement and joined to and spaced longitudinally from said longitudinal surrounding walls to define an envelope receiving slot of uniform width throughout extending perpendicular to said direction of movement, a ram extending into said open end of said sleeve whereby said sleeve and said ram are movable relative to each other in telescoping, linear reciprocal fashion in said longitudinal direction of movement, a blade mounted on said ram having at least one cutting edge directed toward said slot and disposed within said cavity and extending in said longitudinal direction of movement, means operable externally of said sleeve and said ram for adjustably limiting the extent of relative longitudinal movement between said ram and said sleeve to control the maximum extent to which said blade is movable longitudinally into said slot and to prevent said cutting edge of said blade from extending across the entire width of said slot, and biasing means captured within said cavity and between said sleeve and said ram and disposed to urge said cutting edge of said blade away from said slot.

2. A device according to claim 1 wherein said biasing means is a compressed coil spring disposed between said sleeve and said ram.

3. A device according to claim 2 wherein together said ram and said sleeve define an enclosed spring compartment having opposite, transverse end walls, one of which is formed by the structure of said sleeve and the other of which is formed by the structure of said ram and said spring is longitudinally oriented within said compartment and is compressed between said opposite end walls.

4. A device according to claim 3 further comprising a spring guide interposed between said spring and said end wall formed by said structure of said ram.

5. A device according to claim 4 wherein said blade is formed with a surface discontinuity and wherein said ram is formed with a blade engaging stud which projects laterally into said spring compartment, and said blade is mounted in said spring compartment such that said blade engaging stud engages said surface discontinuity of said blade and said spring guide constrains said blade against lateral movement within said spring compartment.

6. A device according to claim 1 wherein said sleeve is formed with a longitudinally oriented track closed at both ends and located adjacent to said ram and said ram is formed with a depressible tang which projects into said track to thereby hold said ram and said sleeve together in a releasable manner.

7. A device according to claim 1 wherein said means for adjustably limiting relative movement between said ram and said sleeve is comprised of a disk mounted for rotation on one of said ram and said sleeve about an eccentric axis perpendicular thereto and the other of said ram and said sleeve is relatively movable in longitudinal reciprocation into abutment therewith.

8. An implement for opening envelopes comprising a hollow sleeve defining a cavity therewithin and forming a transverse channel at one extremity thereof, a ram element disposed within said cavity, guide means acting between said sleeve and said ram to limit relative movement therebetween to longitudinal reciprocation, a blade disposed within said cavity and having a cutting edge directed toward said transverse channel, adjustable blade movement control means which limits the extent to which said cutting edge of said blade projects into said channel to a predetermined distance which is less than the width of said channel, and spring biasing means which acts to bias said ram relative to said channel such that said cutting edge of said blade is retracted within said cavity of said sleeve.

9. An implement according to claim 8 wherein said sleeve defines a transverse partition, one side of which defines a wall of said channel and the other side of which defines a transverse bearing wall, and said ram also defines a transverse tearing wall longitudinally displaced from that of said sleeve, and said spring biasing means is comprised of a coil spring compressed between said transverse bearing walls.

10. An implement according to claim 9 further comprising means for maintaining said coil spring in longitudinal alignment between said transverse bearing walls.

11. An implement according to claim 8 in which said ram defines a laterally projecting stud and said blade is formed with an aperture therethrough, and said blade is immobilized from longitudinal movement relative to said ram by engagement cf said laterally projecting stud in said aperture of said blade.

12. An implement according to claim 8 wherein one of said sleeve and said ram is formed with a laterally projecting depressible member and the other of said sleeve and said ram is formed with a longitudinally aligned track closed at both ends, whereby said depressible member extends into said track to releasably hold said sleeve on said ram.

13. An implement for opening envelopes comprising a hollow sleeve defining a cavity therewithin and open at one end and closed at an opposite end by a transverse means which defines a transverse envelope receiving crevice, ram mounted for longitudinal reciprocation within said cavity of said sleeve and extending into said open end thereof, a blade disposed within said cavity and having a cutting edge directed toward said envelope receiving crevice, an adjustable blade movement control means which limits the extent to which said blade projects into said crevice to less than the width thereof, and spring biasing means acting between said sleeve and said ram to urge said cutting edge of said blade away from said transverse crevice and into said cavity.

14. An implement according to claim 13 wherein said spring biasing means is comprised of a longitudinally aligned compressed coil spring interposed between said sleeve and said ram to urge said ram away from said opposite end of said sleeve.

15. An implement according to claim 14 further comprising releasable means for preventing said ram and said sleeve from separating from each other.

16. An implement according to claim 13 wherein said width of said channel is no greater than about 0.5 centimeters.

* * * * *